US006068210A

United States Patent [19]

Risa

[11] Patent Number: 6,068,210

[45] Date of Patent: May 30, 2000

[54] SPOOLING DEVICE, ESPECIALLY FOR THE SPOOLING OF LOAD STRAPS

[75] Inventor: Bjørn Gunnar Risa, Nærbø, Norway

[73] Assignee: Ripro AS, Naerbo, Norway

[21] Appl. No.: 09/230,726

[22] PCT Filed: Jul. 17, 1997

[86] PCT No.: PCT/NO97/00186

§ 371 Date: Jan. 29, 1999

§ 102(e) Date: Jan. 29, 1999

[87] PCT Pub. No.: WO98/04490

PCT Pub. Date: Feb. 5, 1998

[30] Foreign Application Priority Data

Jul. 29, 1996 [NO] Norway ..... 963160
Dec. 13, 1996 [NO] Norway ..... 965344

[51] Int. Cl.[7] ..... B65H 19/28

[52] U.S. Cl. ..... 242/532.5; 242/532.6; 242/423.1; 242/395; 242/396.9; 242/586.5

[58] Field of Search ..... 242/532.5, 532.6, 242/423.1, 396.9, 395, 586.5

[56] References Cited

U.S. PATENT DOCUMENTS

| | | | |
|---|---|---|---|
| 649,694 | 5/1900 | Hunter | 242/532.5 |
| 1,183,819 | 5/1916 | Keiser | 242/586.5 |
| 1,542,435 | 6/1925 | Carlson | 242/396.9 X |
| 2,948,487 | 8/1960 | Locklin . | |
| 3,954,226 | 5/1976 | Pickering | 242/395 |
| 4,007,887 | 2/1977 | Vice . | |
| 4,551,127 | 11/1985 | Rich et al. | 242/586.5 X |
| 4,679,745 | 7/1987 | Kim | 242/423.1 |
| 4,770,361 | 9/1988 | Maeda | 242/532.5 |
| 4,807,347 | 2/1989 | Johnson | 242/532.6 X |
| 5,433,565 | 7/1995 | Chan . | |
| 5,533,687 | 7/1996 | Tice | 242/532.5 X |
| 5,611,520 | 3/1997 | Soderstrom | 242/532.6 X |

FOREIGN PATENT DOCUMENTS

| | | | |
|---|---|---|---|
| 946586 | 8/1956 | Germany | 242/532.5 |
| 25 42 955 C2 | 8/1982 | Germany . | |
| 44 10 308 A1 | 6/1995 | Germany . | |
| 930526 | 8/1994 | Norway . | |
| 716109 | 9/1954 | United Kingdom | 242/586.5 |
| 1051676 | 12/1966 | United Kingdom | 242/586.5 |
| 2 295140 A | 5/1996 | United Kingdom . | |

OTHER PUBLICATIONS

Service De La Propriete Industrielle, Brevet D'Invention No. 543054, "Tendeur D'Haubannage Avec Systeme D'Enroulement de Cable", Sep. 1959.

*Primary Examiner*—Donald P. Walsh
*Assistant Examiner*—Minh-Chau Pham
*Attorney, Agent, or Firm*—Sue Z. Shaper; Felsman, Bradley, Vaden, Gunter & Dillon, L.L.P.

[57] ABSTRACT

A spooling device for load straps comprising a spool, which at one end portion is freely rotatably supported and is formed as a projection and has a centrally passing axial bore for receiving an axle, at the end opposite the free outer end of the spool, the axle is drivingly connected to a manual crank, the spool formed with a V-shaped notch tapering radially towards the bore, and the axle provided with a radially directed, strip-shaped clamping jaw, whose free edge extends parallel to the axis of rotation of the axle/spool and forms the carrier of the axle, for affecting and rotating the spool, the surface of the clamping jaw of the axle, facing the direction of the rotation, and the opposite clamping jaw surface defining the spool notch, form a co-operating clamping surface pair by which the strap end is clamped and kept clamped during the entire spooling operating as long as the cranking is kept up.

13 Claims, 7 Drawing Sheets

SPOOLING DEVICE, ESPECIALLY FOR THE SPOOLING OF LOAD STRAPS

This application claims priority based on PCT/NO97/00186, NO 963160 and NO 965344.

BACKGROUND OF THE INVENTION

1. Field of the Invention

The present invention relates to a spooling device, especially for the spooling of load straps, comprising a rotatable spool and an operating means, for example a manual crank, in which the load strap or similar to be spooled, is secured to the spool.

2. Description of Related Art

The spooling device according to the invention is not restricted to the spooling of load straps, as it is just as suitable for spooling other elongated, band-shaped elements, for example fire hoses. Especially by load straps, the spooling on the rotatable spool of the spooling device shall follow an approximately perfectly helical path in which the successive windings of strap mainly completely overlap in the radial direction, and in which each strap winding bears tightly against immediately adjacent strap windings. This has been difficult or impossible to achieve with known spooling devices of similar kind.

A problem with spooling devices of the kind in question is how to secure, directly or indirectly, the free strap end to the rotatable spool, and another problem consists in enabling release of the spooled roll-shaped strap from the spooling device quickly and without disturbing the spooled roll-shaped strap.

To ensure the position of the load on a load platform, several load straps are usually provided transverse to the longitudinal direction of the load. Spooled load straps are thrown by the driver from one side of the load platform to the other side thereof. After a successful throw, by which the strap spools out successively during its movement across the platform and load, the strap finally comes to rest loosely across the load. Then the driver hitches the securing hook at the one end of the strap to an adjacent hole/loop on one outer side of the load platform, and then walks around to the other side of the load platform, where he picks up the other free, outer end of the strap, which is then secured in a known manner to the load platform by way of a tightening device.

When the transport is completed, the load is released by loosening and removing the straps, whereafter they are normally spooled by hand without any suitable spooling device, which is inconvenient and time-consuming work often resulting in inaccurate spooling.

The load strap must be spooled to enable throwing across the load.

A spooling device of the initially mentioned kind is disclosed in U.S. Pat. No. 5,433,565, which concerns for example hose drums in connection with irrigation. This hose or strap drum has an axially outer, hollow drum extension projecting from the mounting plate of the drum on the one side, this hollow extension being formed with through radial holes for the insertion and locking of the mounting portion of a crank.

In U.S. Pat. No. 1,183,819 is described a securing device for fabric, band, line or similar, in which an elongated tubular carrier surrounds a likewise elongated gripper with a longitudinal, radially projecting rib pivotally engaging a through slot in the carrier. The slot constitutes an opening for the insertion and locking of the fabric etc. which is inserted through the slot and placed around the internal, elongated gripper and out through the slot on the opposite side of the rib of the gripper, which is pivoted towards the slot edge adjacent to the pulled-out portion of the fabric, for the securing of the latter. However, this known device is constructed in such a manner, that it is unsuitable for spooling said fabric, band, line or similar. Furthermore, the securing effect is based on the inner gripper being freely movable vertically in relation to the surrounding carrier, and on releasing the fabric or similar the inner gripper must consequently be lifted. This makes the release rather unpractical.

Winding drums/spools are known, in the winding surface of which are formed grooves, into which locking means are inserted, for example in the form of wedge-shaped blocks, to provide for securing of the end of the strap etc. which is to be spooled. The locking blocks are normally unpractical to displace from a position in which they secure the end of a strap or similar to the winding drum, into a position in which the band end is released. Examples of such securing devices by winding drums appear from U.S. Pat. No. 2,948,487, DE 44 10 308 and DE 25 42 955.

SUMMARY OF THE INVENTION

Thus, there is a need for a spooling device with a securing means for the strap, which may easily be brought into active position for the safe securing of the end portion of the strap, and which is either easily released or formed and arranged so that it is not obstructing axial withdrawal of a spooled, roll-shaped strap, i.e. in the direction of the axis of the rotatable spool, when the spool is no longer subjected to rotational forces.

Further it is aimed at lateral support of the strap during spooling.

An operating crank is used, which directly or indirectly rotates a rotatable spool on which the strap is spooled, a free outer end of the strap being brought into fixing engagement with the rotatable spool, so that the operator may rotate the crank by one hand, while using his other hand to adjust the strap, remove small foreign bodies adhered to the strap etc.

It is aimed at realizing these objects by means of simple and cheap means, while, at the same time, a spooling device which is easy and convenient in handling is to be provided, and with which also inexperienced operators at all times may be sure of a tidy result of the spooling.

BRIEF DESCRIPTION OF THE DRAWINGS

Preferred embodiments will be explained in detail in the following with reference to the accompanying drawings, in which FIG. 1–5 show a first embodiment of a spooling device according to the invention, whereas

FIG. 1 showing a perspective view of a spooling device according to said first embodiment, in which the free end portion of a flexible load strap or similar is about to be inserted into the nip between one surface of a first clamping jaw, carried by the axle of the spooling device, and an opposite spool surface, forming a second clamping jaw and otherwise contributing to the definition of a radially directed V-shaped notch, formed in a defined spool which is coaxial with the axle but otherwise freely rotatable, and about which the strap is to be spooled, whereby there is a relative rotatability between the axle and the spool within said radially directed, V-shaped spool notch;

FIG. 2 showing the same as FIG. 1, but the end portion of the strap here being clamped between the surfaces of the first and the second clamping jaws as a result of the rotation of the axle from the position shown in FIG. 1 into that shown in FIG. 2;

FIG. 3 showing the same as FIGS. 1 and 2, but here the radially projecting clamping jaw of the axle, working as a carrying means for the rotation of the spool, has affected said second clamping surface and caused the rotation of the spool, the axle and the spool in FIG. 3 having made almost one revolution compared to FIG. 1;

FIG. 4 showing the same as FIGS. 1–3, but here the strap is spooled on the spool completely;

FIG. 5 showing a vertical axial section, but only a portion of the supporting frame and crank of the spooling device;

FIG. 6 showing an embodiment of the spooling device according to the invention, only deviating from the embodiment shown in FIG. 1–5 in the strap end securing means itself;

FIG. 7 showing the same as FIG. 6, but here the free end portion of the strap is inserted into mainly flush, radially directed slots in spool and axle, in which the strap end is essentially clamped between the lower slot-defining edge of the spool and the adjacent slot-defining edge of the axle.

DETAILED DESCRIPTION OF THE PREFERRED EMBODIMENTS

Reference is first made to the embodiment shown in FIGS. 1–5, in which a spooling device for load straps are constructed on a very simple supporting frame, in the exemplary embodiment in the form of a bent, cut plate 10 having a 90° deflected base portion 10', an intermediate carrying portion 10" for the mounting of a sleeve shaped spool 14 with a through drive shaft, and an upper, laterally projecting support portion 10'", which the adjacent edges of a strap 12 may be brought to bear against, for improved accuracy in the spooling, so that radially adjacent strap windings overlap as completely as possible, whereby the ready, helically wound strap 12 practically has flat opposite side surfaces.

The outer free end of the strap 12 which is to be releasably secured to the spool 14, is designated by 12'.

Figure 5:
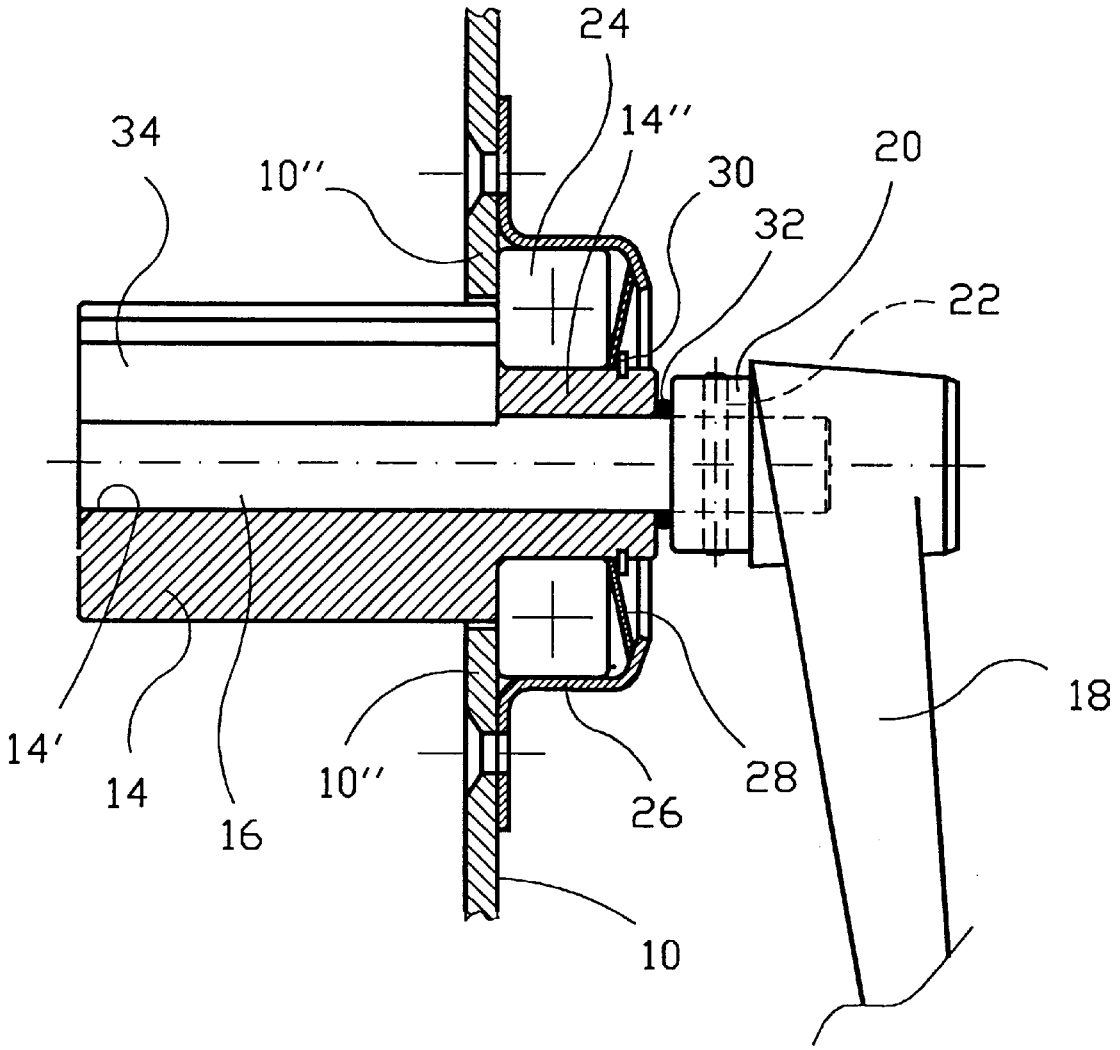

The spool 14, which may be of a plastic material, has a through axial bore 14' receiving a concentric axle 16, whose end portion opposite the free end of the spool 14 is drivingly connected to a crank 18 by means of a locking ring 20 and a transverse pin 22, see FIG. 5.

Figure 4:
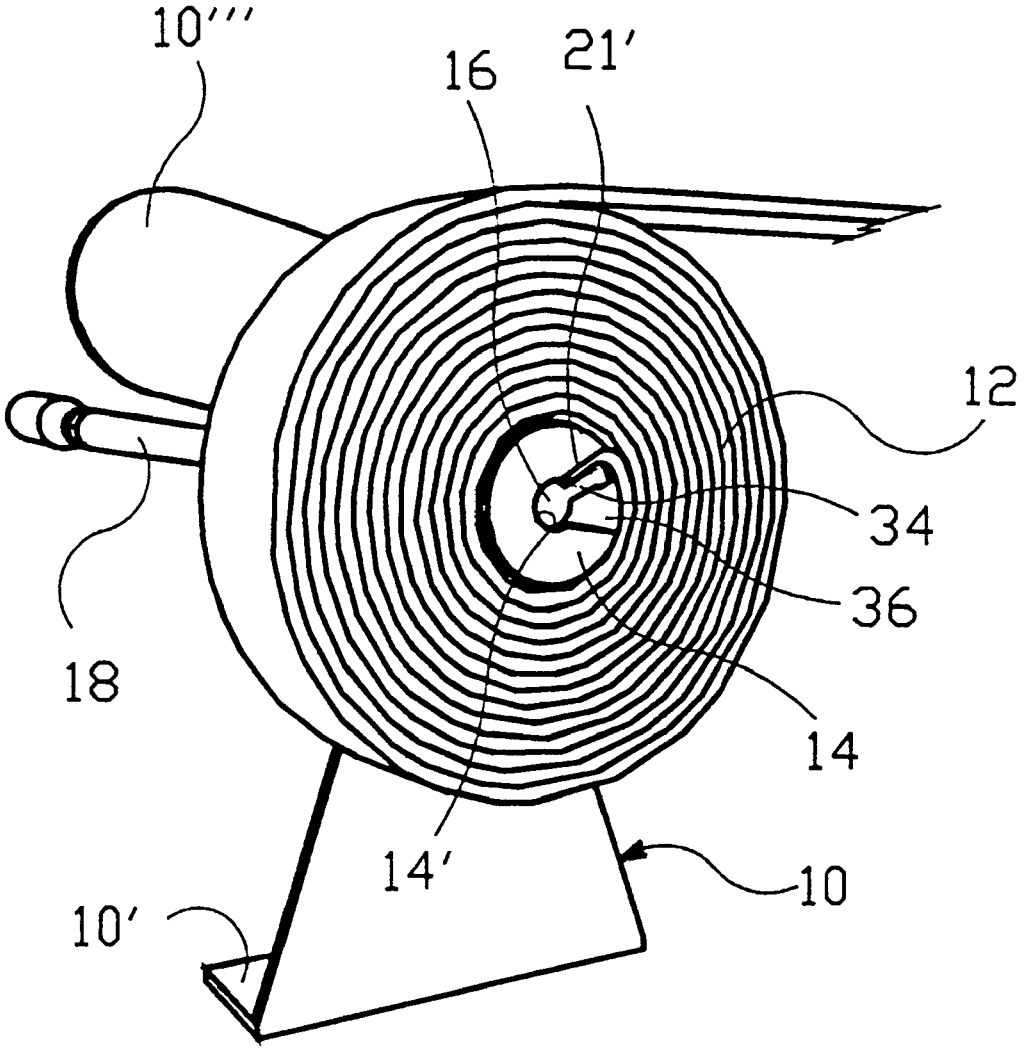

The spool 14 and thus the coaxial axle 16 have the form of a projection, so that a completely spooled load strap 12, FIG. 4, may be pulled off the spool 14 axially, without any obstructions, so that the accurate spooling is maintained by the pulled-off load strap coil having the form of a disc.

The spool 14 has a tapered mounting portion 14" surrounded by the rotational part of a ball bearing 24, schematically shown in FIG. 5, the stationary circumferential part of which is held in place by a cup-shaped cover 26 which also surrounds a central, saucer-shaped blade spring, a disc spring 28, which again is held in place and pressed brakingly against the inner bearing ring of the bearing 24. A retaining ring 30 engages a circumferential groove in the mounting portion 14" of the spool, locking the mounting portion 14" and the spool 14 against the disc spring 28. The reference numeral 32 designates an O-ring-seal placed between the end surface of the spool mounting part 14" and the opposite end surface of the locking ring 20.

In the embodiment according to FIGS. 1–5 the strap end securing device has the form of two co-operating clamping jaw surfaces. A first radially directed clamping jaw surface 34' is located on an axially extending, strip-shaped clamping jaw 34 formed on the axle 16, and an opposite clamping jaw surface 36' possibly 36" incorporated in the spool, which on one side defines an essentially radially directed, V-shaped notch 36, extending radially tapering from the outer surface of the spool, into its through bore 14' for the axle 16.

Since the axle 16 is driven directly by the crank 18, while the spool 14 is mounted for free rotation on the bearing 24, apart from the braking implemented by means of the disc spring 28, there will be a rotatability of the axle 16 within the V-shaped notch 36 relatively to the spool 14. Thus, when the strap end portion 12' is inserted between the two clamping surfaces 34' and 36', with the clamping jaw 34 at its maximum or essentially maximum distance from the clamping surface 36' of the spool 14, and the crank 18 is subjected to an initial torque, the clamping jaw 34 of the axle will be rotated in the direction of the clamping jaw surface 36' of the spool notch 36, so that the end portion 12' of the strap 12 is clamped between the clamping jaw surfaces 34', 36', while the spool 14 because of its braking cannot yield in the direction of rotation, but to a certain extent resists the rotational movement applied to it by the axle 16 through its clamping jaw 34 and the intermediate strap end portion 12', and this counter force of the spool 14 on the one side and the positive rotational movement of the clamping jaw of the axle ensure a reliable clamping and thereby securing of the strap end. When the spool 16 has rotated 360°, the strap 12 will be self-locking against the underlying strap.

Figure 1:
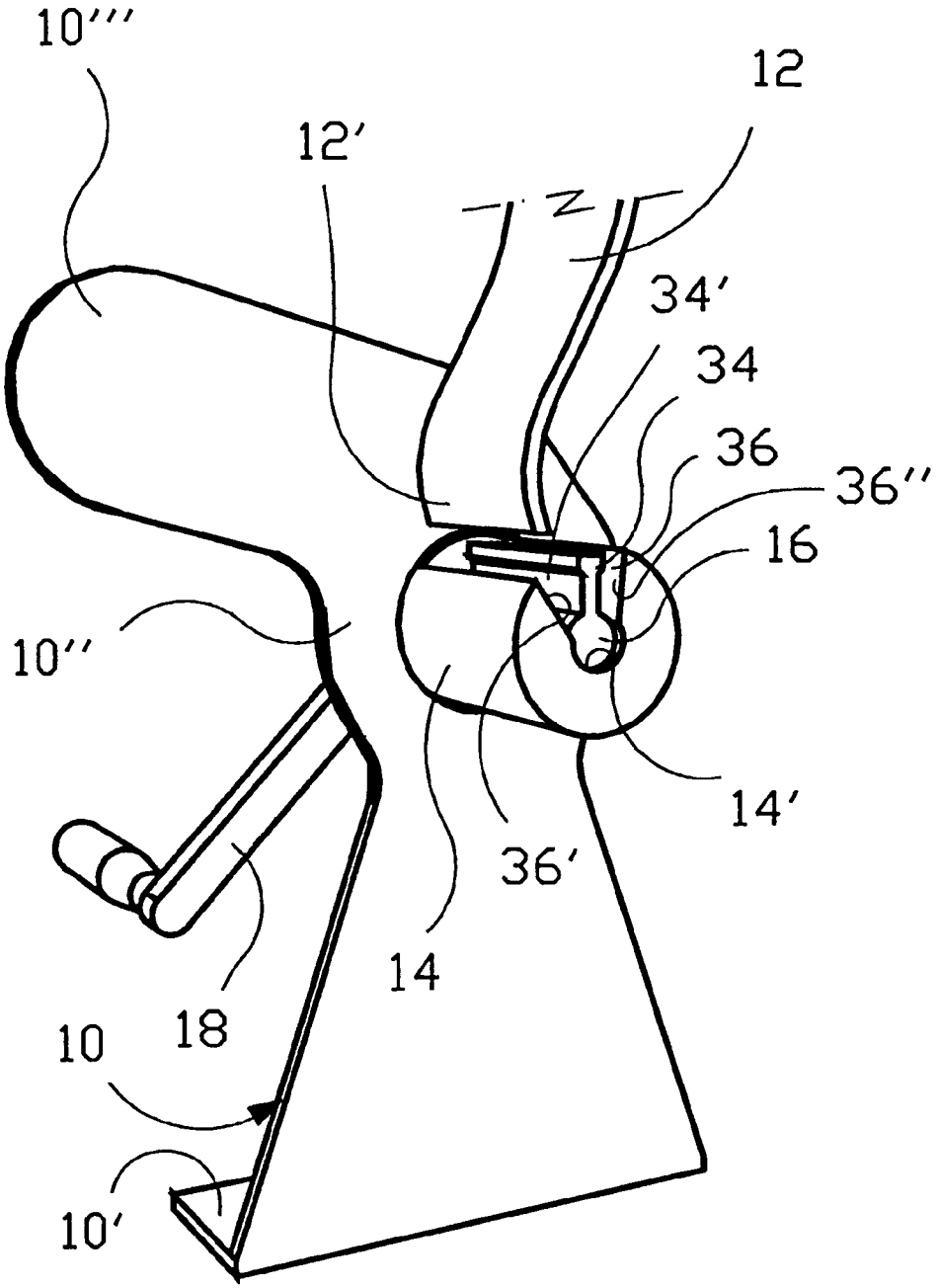
Figure 2:
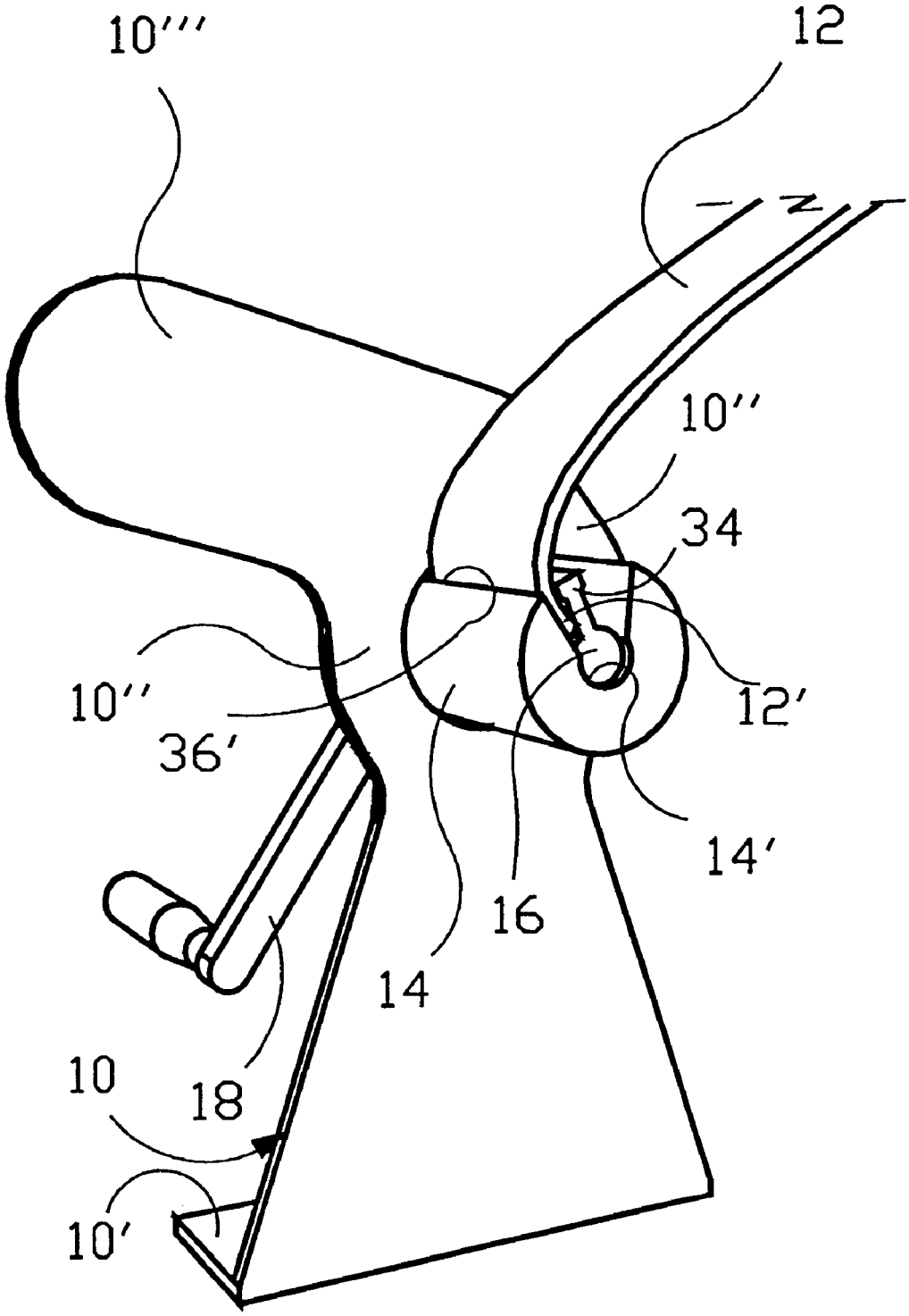
Figure 3:
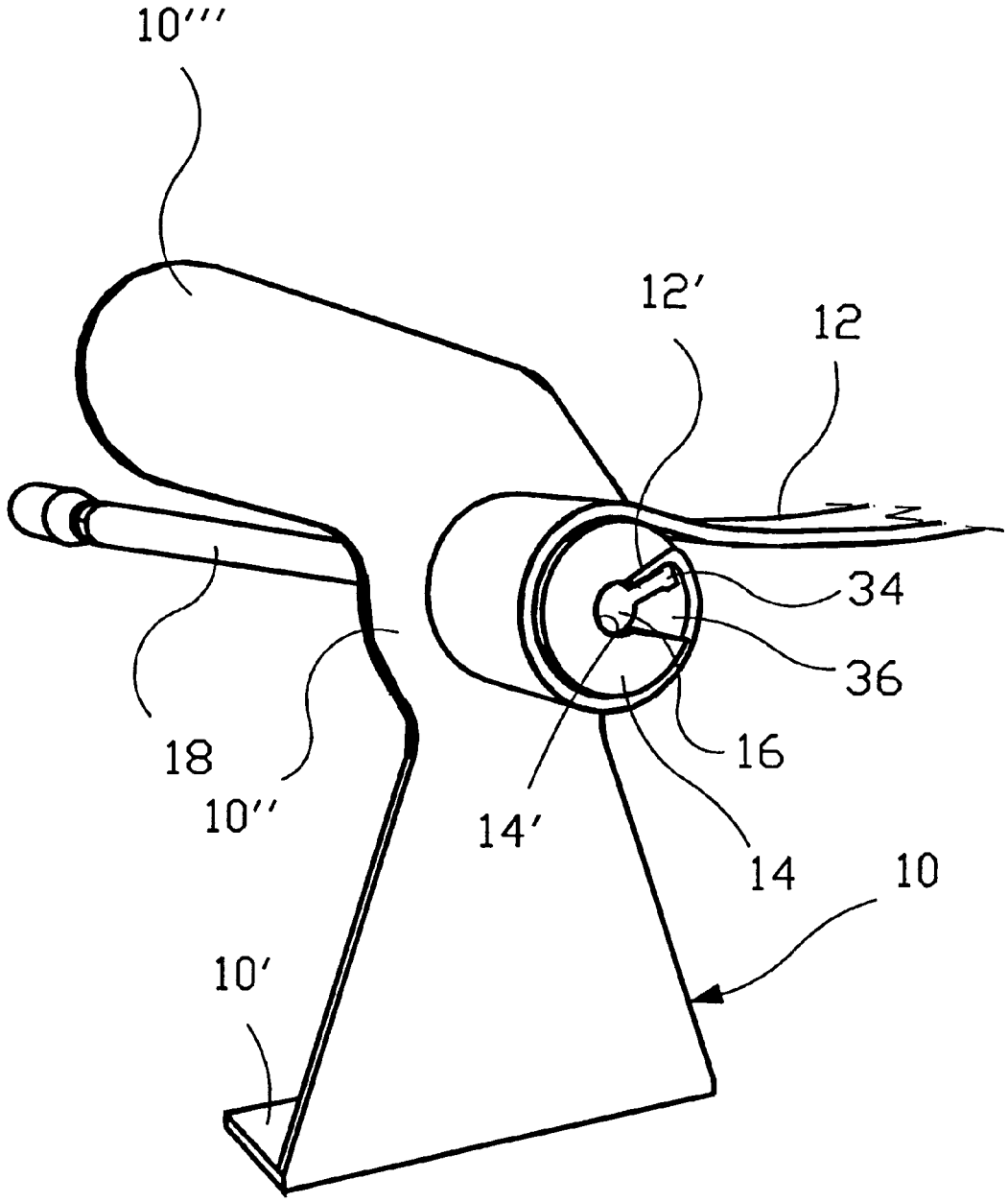

FIGS. 1–3 illustrate in detail how the clamping of the end portion 12' of the strap and the initial spooling is done, while FIG. 4 shows the situation by completed spooling, in which the clamping is also released by stopping the cranking, so that the entire coil of spooled strap may be pulled off the spool 14 without any obstructions.

Figure 6:
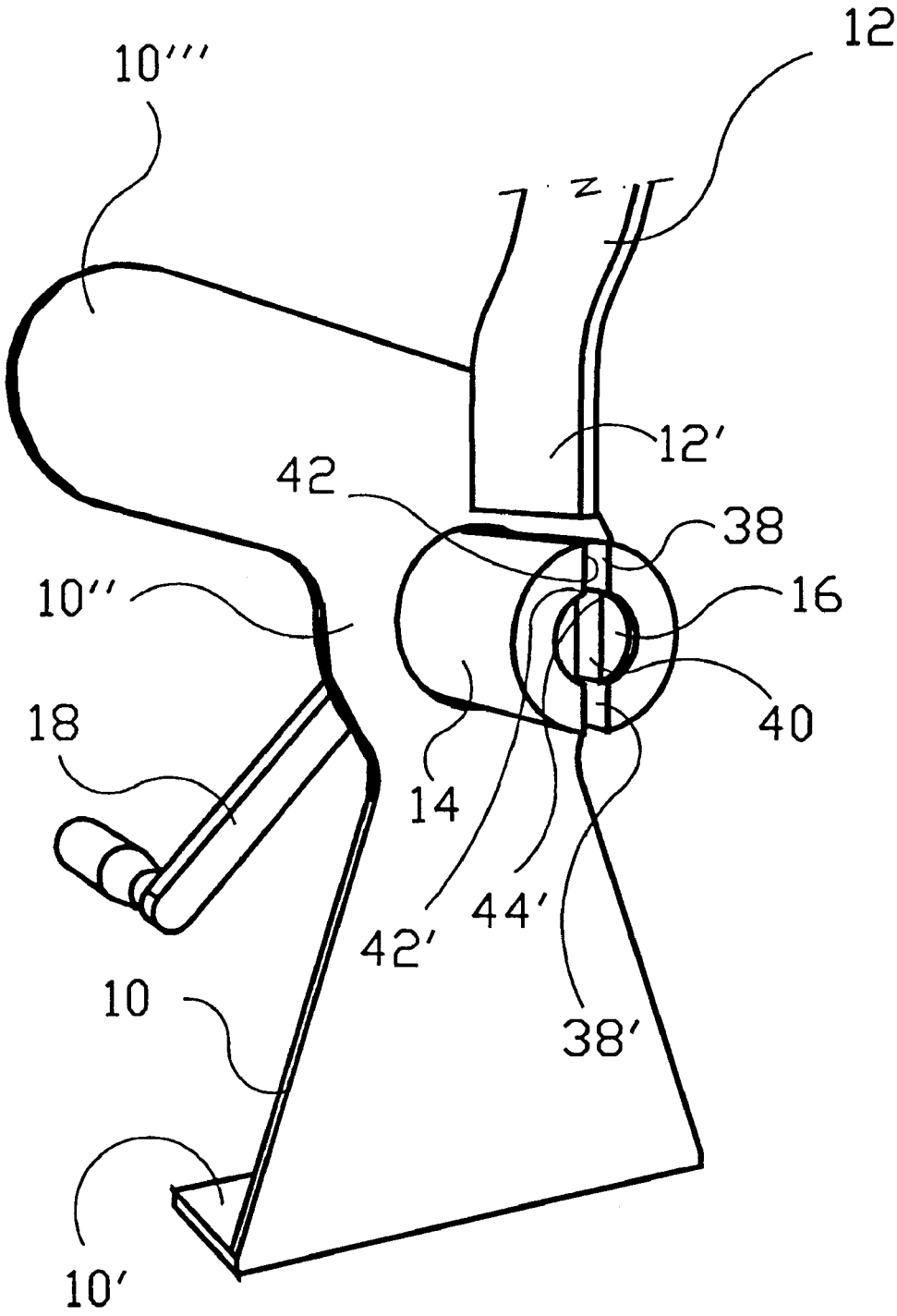
FIGS. 6 and 7 show a second embodiment of same.
Figure 7:
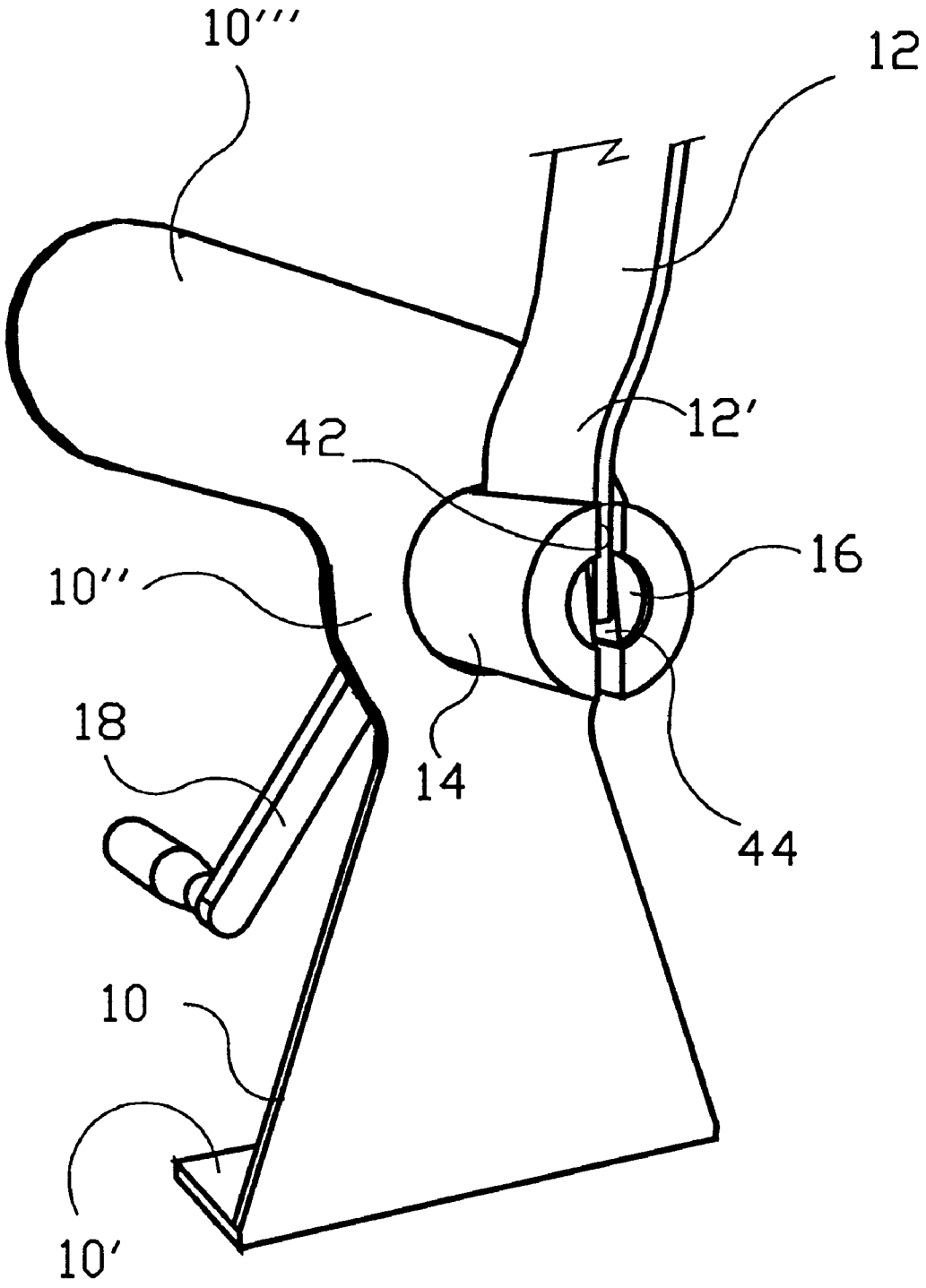

A second embodiment which as a whole is uniform with the present invention, and only exhibits minute differences from the first embodiment shown in FIGS. 1–5, is shown in FIGS. 6 and 7, in which parts and portions of the spooling device being identical with corresponding parts and portions in FIGS. 1–5, have been given the same reference numerals, and—as far as already having been described in detail in connection with the embodiment in FIGS. 1–5—will not be described in detail again.

The spool 14 in FIGS. 6 and 7 is formed with a central, essentially radially directed slot 38, which in the exemplary embodiment extends through centrally opposite sleeve portions. As appears from FIG. 7, which shows the strap end portion 12' in a clamped, fixed position, the slot portion 38', being the lowermost portion as the rotation starts, is not active and therefore not necessary.

The axle 16 has a radially directed, centrally through slot 40, which extends across an axial portion of the axle 16, at least corresponding to the width of the strap 12. As appears from FIG. 7, showing the strap end portion 12' in its clamped, fixed position, the slot in the axle 16 does not have to run through in the radial direction, but to facilitate insertion of the load strap 12 in the horizontal plane, the sleeve 14 and the axle 16 may, however, with advantage be provided with through slots.

Assuming that the spooling device is directed anti-clockwise, a clamping jaw surface 42 is achieved by the spool slot defining surface opposite the direction of spooling, and clamping jaw surface 44, co-operating therewith, by the axle slot defining surface facing the direction of spooling. The maximum clamping effect will be concentrated at the adjacent axially directed edges 42' and 44' of the respective clamping jaw surfaces 42, 44. In this embodiment also, the clamping effect is achieved by the utilization of the relative rotatability of the spool and the axle. As soon as the cranking is stopped, the clamping effect is released, and the finished, spooled strap roll may be pulled off the spool 14 axially.

The supporting frame 10 of the spooling device comprises, as mentioned, a base portion 10' which may be mounted on a suitable base during the spooling operation. The plate-shaped frame 10 also has an upward sloping support portion 10''', which the adjacent side surface of the successively spooled strap coil may brought to bear against, for enhanced spooling accuracy.

I claim:

1. A spooling device for spooling load straps comprising a rotatable spool and an attached means for operating said spool, said operating means including a crank with an axle and a retaining means for securing an end portion of a load strap to the spool, the spool having an axial through-bore receiving a crank axle, a crank axle end being drivingly connected to a rotatable portion of the operating means, the spool having an essentially radially directed notch extending from a circumference to the axial through-bore, the notch defined by inner spool surfaces extending in an axial direction a distance generally corresponding to or exceeding a width of a strap, one of the notch-defining surfaces forming a clamping jaw surface, the crank axle having at least one of a strip-shaped clamping jaw or locking block projecting radially from the crank axle and extending essentially parallel to the axis of rotation thereby forming a co-operating opposite clamping jaw surface such as to retain an end portion of a load strap based on a releasable clamping force.

2. A spooling device according to claim 1 wherein the crank is a manual crank.

3. A spooling device according to claim 1 wherein the spool includes a mounting portion freely rotatably supported in a bearing carried by a supporting frame, operably connected to means for resilient frictional/braking, and wherein the crank axle is drivingly connected to the operating means such that the crank axle has a certain rotateability relative to the spool, the rotateability restricted by the extent of the spool notch in the direction of rotation of the spool.

4. A spooling device according to claim 3 wherein the means for resilient frictional/braking includes a disc spring.

5. A spooling device according to claim 4, wherein the bearing for support of the spool is enclosed in a cup-shaped cover having a mounting flange opposite the frame of the spooling device, and wherein said disc spring is placed with its inner circumference bearing against a bearing and with its outer bearing bearing against the cover, operably connected for braking of the spool when the spool is rotated by the axle, a retaining ring engaging a circumferential slot in the mounting portion of the spool keeping the disc spring in place in its braking position.

6. A spooling device according to claim 3, wherein the spool notch extends from a mounting portion of the spool to a free outer end thereof.

7. A spooling device according to claim 6, wherein the spool notch has an essentially V-like cross-sectional shape and tapers substantially evenly towards, and ends into, the spool bore, and wherein one of the inner surfaces defining the notch and opposite the direction of rotation forms the clamping jaw surface of the spool while the co-operating clamping jaw surface carried by the axle is formed on at least one of a strip-shaped clamping jaw or locking block projecting radially from the crank axle and extending essentially parallel to the axis of rotation thereby forming a carrier to operate on the spool through the clamping jaw surface thereof by the intermediate strap.

8. A spooling device according to claim 3, wherein the spool notch has an essentially V-like cross-sectional shape and tapers substantially evenly towards, and ends into, the spool bore.

9. A spooling device for spooling load straps comprising a rotatable spool and an attached means for operating said spool, said operating means including a crank with an axle and a retaining means for securing an end portion of a load strap to the spool, the spool having an axial through-bore receiving a crank axle, a crank axle end being drivingly connected to a rotatable portion of the operating means, the spool having a radially directed slot which extends transversely through the sleeve wall in a central portion of the spool, and wherein the crank axle is formed with a largely radially through slot operably connected to be brought flush with the spool slot immediately before the securing of a strap end as a relative rotation of the crank axle and the spool locks the strap end between co-operating clamping portions respectively on the spool and on the crank axle in their respective slots by the intermediate strap such that rotation of the crank axle drivingly rotates the spool by pressure transmitted through the intermediate strap between the co-operating clamping portions.

10. A spooling device for spooling load straps comprising a rotatable spool and an attached means for operating said spool, said operating means including a crank with an axle and a retaining means for securing an end portion of a load strap to the spool, the spool having an axial through-bore receiving a crank axle, a crank axle end being drivingly connected to a rotatable portion of the operating means, the spool having an essentially radially directed notch extending from a circumference to the axial through-bore, the notch defined by inner spool surfaces extending in an axial direction a distance generally corresponding to or exceeding a width of a strap, one of the notch-defining surfaces forming a clamping jaw surface, the crank axle forming a co-operating opposite clamping jaw surface such as to retain the end portion of the load strap based on a releasable clamping force and such as to drivingly rotate the spool by pressure through said clamped end portion between the co-operating opposite clamping jaw surface.

11. A spooling device for spooling load straps comprising a rotatable spool and an attached means for operating said spool, said operating means including a manual crank with an axle and a retaining means for securing an end portion of a load strap to the spool, the spool having an axial through-bore receiving said crank axle, said crank axle end being drivingly connected to a rotatable portion of the operating means, the spool having an essentially radially directed notch extending from a circumference to the axial through-bore, the notch being defined by internal spool surfaces extending in an axial direction a distance at least corresponding to a width of the strap, one of the notch-defining surfaces forming a clamping jaw surface, the crank axle forming a co-operating opposite clamping jaw such as to retain the end portion of the load strap based on a releasable clamping force, said crank axle being drivingly connected to the operating means such that the crank axle has a certain rotateability relative to the spool, said rotateability restricted to the extent of the spool notch in the rotational direction of the spool, said spool notch having an essentially V-like cross-sectional shape, tapering substantially evenly towards the spool bore, ending therein, and wherein one of the notch-defining, internal spool surfaces, opposite the rotational direction, forms the clamping jaw surface of the spool while the co-operating clamping jaw surface carried by the crank axle is formed on at least one of a strip-shaped clamping jaw serving as a locking block, projecting radially from the crank axle and extending essentially parallel to the axis of rotation thereby forming a carrier to operate the spool through the clamping jaw surface thereof by the intermediate strap.

12. A spooling device as set in claim 11, wherein the spool includes a mounting portion freely rotatably supported in a bearing carried by a supporting frame, operably connected to means for resilient frictional braking including a disc spring, and wherein the spool notch extends from a mounting portion of the spool to a free outer end thereof.

13. A spooling device as set forth in claim 12, wherein the bearing for support of the spool is enclosed in a cup-shaped cover having a mounting flange opposite the frame of the spooling device, and wherein said disc spring is placed, with its inner circumference resting against a bearing and with its outer circumference resting against the cover, operably connected for braking of the spool when the spool is rotated by the crank axle, a retaining ring engaging a circumferential slot in the mounting portion of the of the spool, keeping the disc spring in place in its braking position.

* * * * *